United States Patent [19]

Brede et al.

[11] Patent Number: 4,690,056

[45] Date of Patent: Sep. 1, 1987

[54] ELECTRIC DETONATOR DEVICE

[75] Inventors: Uwe Brede, Furth; Gerhard Kordel, Nuremberg, both of Fed. Rep. of Germany

[73] Assignee: Dynamit Nobel Aktiengesellschaft, Troisdorf, Fed. Rep. of Germany

[21] Appl. No.: 696,905

[22] Filed: Jan. 31, 1985

[30] Foreign Application Priority Data

Jan. 31, 1984 [DE] Fed. Rep. of Germany ..... 3403179

[51] Int. Cl.[4] ..... F42B 3/18; F42C 19/12

[52] U.S. Cl. ..... 102/202.2; 102/202.5

[58] Field of Search ..... 102/202.1, 202.2, 202.5

[56] References Cited

U.S. PATENT DOCUMENTS 2,818,020 12/1957 Burklund ..... 102/202.1
3,804,018 4/1974 Janoski ..... 102/202.1
4,393,779 7/1983 Brede et al. ..... 102/202.5

FOREIGN PATENT DOCUMENTS 581316 8/1959 Canada ..... 102/202.5
76210 4/1983 European Pat. Off. ..... 102/202.5
2840738 2/1980 Fed. Rep. of Germany .
1419775 12/1975 United Kingdom .

*Primary Examiner*—Charles T. Jordan
*Attorney, Agent, or Firm*—Antonelli, Terry & Wands

[57] ABSTRACT

An electric detonator device including an insulating carrier member carrying an ignition bridge and first and second electrodes connected to the ignition bridge. At least one of the electrodes is provided in the form of a layered conductor path configured to provide a high-frequency filter so as to prevent high-frequency interference signals from passing to the ignition bridge and causing misfiring.

22 Claims, 9 Drawing Figures

ELECTRIC DETONATOR DEVICE

Figure 1:
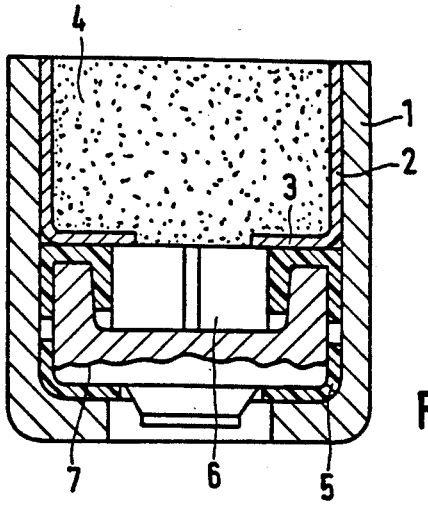

This invention relates to an electric detonator device with an electrically insulating carrier member carrying an ignition bridge and two electrodes connected to the ignition bridge, at least one of the electrodes having a layered conductor path.

In a conventional detonator device of this type (DOS No. 2,747,163), the electrodes applied in layer fashion to the carrier member are simultaneously the connecting elements for effecting connection of discrete components, such as zener diodes, transistors, resistors, or the like. The conductor paths have connection points to which the legs or terminals of the electric components are soldered. In addition to the electrodes, still other conductor paths can be applied to the carrier member, serving as connection lines and for the connection of discrete electric components.

Furthermore, an electric detonator device has been known (DOS No. 2,840,738) wherein both electrodes are fashioned as junction electrodes joined by means of a narrow conductor strip constituting the ignition bridge. The junction electrodes are separated from each other by an insulating recess in the carrier member and are joined exclusively by the ignition bridge.

In the conventional detonator devices, the electrodes in each case fulfill merely the function of current conductors, be it for the purpose of supplying current to the ignition bridge or for supplying current to the components of an electric circuit mounted on the carrier member.

Protective measures have been known for making detonator devices safe against unintended triggerin by high-frequency electromagnetic interference signals. It is possible, for example, to connect series resistors, filter circuits, and the like into the lines leading to the electrodes of the detonator device in order to prevent transmission of interference voltages to the detonator device. While series resistors exhibit the drawback that they damp not only the high-frequency interference voltages but also cause a voltage drop in the DC voltage utilized for ignition, frequency eliminate only the high-frequency interference signals; whereas the DC current properties of the ignition circuit remain unchanged. The disadvantage of the conventional protective circuits consisting of discrete components resides in that conductor sections lead from the protective circuit to the ignition bridge, and that these conductor sections, in turn, constitute receiving antennas which can receive high-frequency interference voltages. Therefore, an especially intense shielding is required in this zone.

It is, therefore, an object of the present invention to provide an electric detonator device of the type having an electrically insulating carrier member carrying an ignition bridge and two electrodes connected to the ignition bridge wherein at least one of the electrodes has a layered conductor path and which electric detonator device is protected with a simple arrangement effectively against high-frequency electromagnetic interferences without requiring expensive shielding measures.

According to this invention, this object has been attained by constructing the layered conductor path as a high-frequency filter.

The invention offers the advantage that additional discrete components for realizing the high-frequency filter are not required, and that the high-frequency filter is arranged in the immediate vicinity of the ignition bridge to be protected from high-frequency interferences, so that there is no possibility for inducing interference voltages behind or within the high-frequency filter. The detonator device can be realized with a simple arrangement and low cost since, as compared with existing detonator devices, it is merely necessary to change the configuration of one electrode or of both electrodes. The electrode or electrode arrangement constructed as a high-frequency filter does not perform the function of a circuit board but rather is an integral part of the electric contacting portion of the ignition bridge, the filter components being created by a skillful modification of the connecting conductor paths.

The high-frequency filter can be constructed with a bandpass filter or a high-pass filter, so that the direct current or the low-frequency alternating current utilized for ignition can pass the filter without damping. The techniques for designing conductor paths as an inductance or capacitance are known from the thick-film technology.

According to a preferred embodiment of the invention, the conductor path is constructed entirely or in sections as a series inductance based on the ignition bridge, varying zones of the conductor path extending with a substantially constant spacing along nonlinear routes, whereby, for example, the conductor path is made helical or spiral shaped. Aternatively, however, the inductance can have the form of an open loop, for example. As is known, a series inductance has a filtering effect. The frequency drop produced at this inductance is proportional to the frequency. Its direct-current resistance is practically equal to zero.

Additionally, the conductor path which contains the series inductance can be constructed in sections as a series capacitance based on the ignition bridge, while the conductor path outside of the zone of the inductance is geometrically configured so that areas are created which are located a short distance apart. The separation or interruption of these areas is preferably meander-shaped. In this way, a parallel-resonant circuit can be formed from a series inductance and a series capacitance which is in series with the ignition bridge.

According to another preferred embodiment of the invention, the provision is made that the conductor path, together with a conductor path of the other electrode, forms a parallel capacitance with respect to the ignition bridge, both conductor paths extending at close mutual spacing substantially in parallel to each other. Such a parallel capacitance performs the function of an anti-interference capacitor which short-circuits high-frequency oscillations.

Figure 2A:
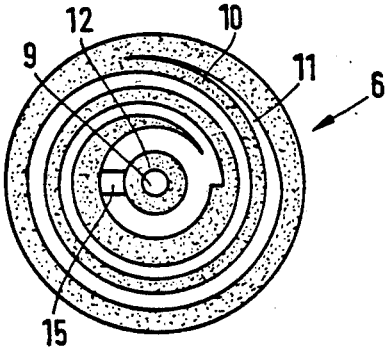
Figure 3A:
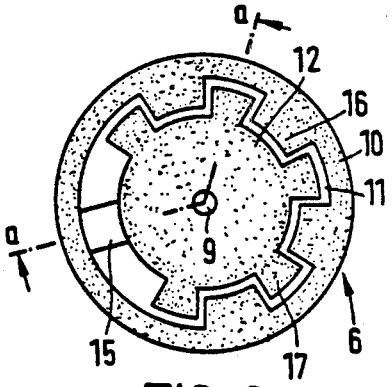
Figure 2B:
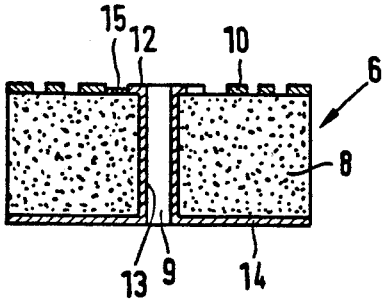
Figure 3B:
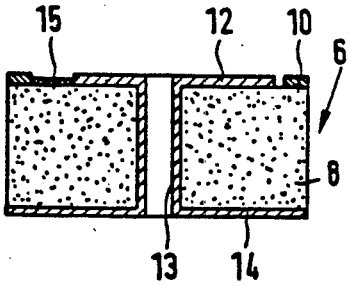

The present invention will become apparent from the following detailed description taken in conjunction with the accompanying drawings, in which:

FIG. 1 is a longitudinal sectional view of a detonator device in the form of a layered detonator device;

FIGS. 2*a* and 2*b* show a top view and a longitudinal sectional view of the layered element contained in the layered detonator device of FIG. 1;

FIG. 3*a* is a top view of another embodiment of the layered element and FIG. 3*b* is a sectional view taken along the line a—a of FIG. 3*a;*

Figure 4A:
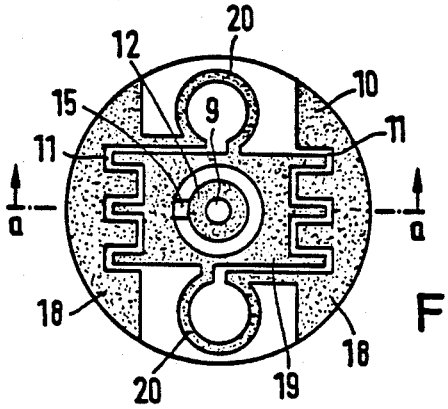
Figure 4B:
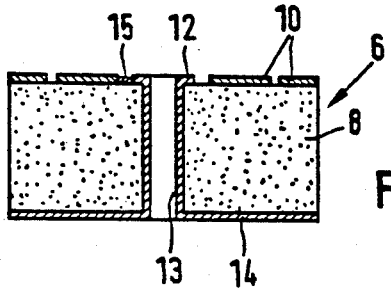
Figure 5A:
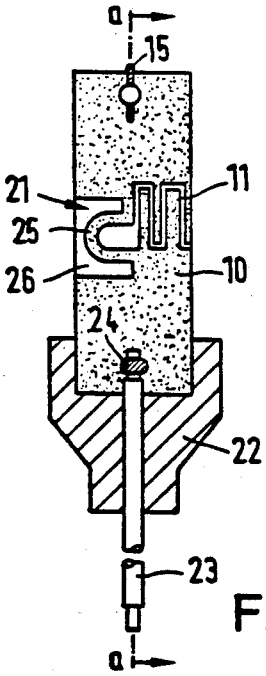
Figure 5B:
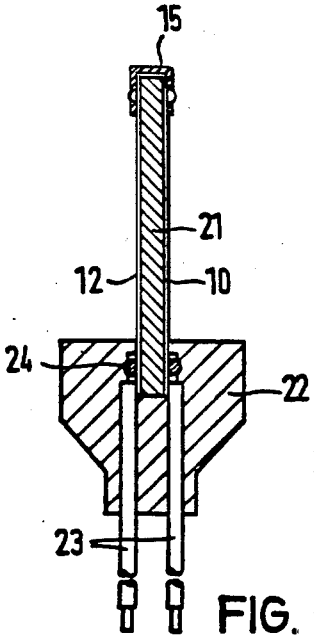

FIG. 4*a* is a top view of another layered element in accordance with this invention and FIG. 4*b* is a sectional view taken along the line a—a of FIG. 4*a;* and FIG. 5*a* shows another embodiment in accordance with this invention, partially in section, while FIG. 5*b* is a sectional view taken along the line a—a of FIG. 5*a.*

Referring now to the drawing, wherein like reference numerals designate like parts throughout the several views, FIG. 1 illustrates an igniter or detonator device including a cylindrical metallic jacket 1 containing a metallic ground contact ring 2 in contact with the inner wall of the jacket. The end 3 of the ground contact ring 2 is bent inwardly to form an internal flange. The ground contact ring 2 contains an initiator 4 in the form of an explosive. The initiator 4 completely fills the ground contact ring 2 and the opening defined by the bent-over end 3.

An insulating member 5 is disposed following the ground contact ring 2 in the jacket 1, this insulating member containing a layered element 6 in direct contact with the initiator 4. The end of the layered element 6 facing away from the initiator 4 is in contact with a metallic pole piece 7, likewise encased by the insulating housing 5 and projecting through an opening in the insulating housing 5. The pole piece forms a contact to an ignition generator while the jacket 1 represents a second electrode for connection to the ignition generator. Upon the application of a voltage between the ground contact ring 2 and the pole piece 7, ignition of the initiator 4 takes place by the layered element 6.

The layered element 6 includes, according to FIGS. 2*a* and 2*b*, a cylindrical insulating carrier member 8 exhibiting a central bore 9 and provided with two electrodes. A first electrode 10 is provided in the form of a layered conductor path covering the top end face of the carrier member 9 and is subdivided by a gap 11 having a spiral-shaped strip of several windings so that also the conductor path 10 has the configuration of a spiral, the external end of which terminates in a circle, and the inner end of which terminates freely. A second electrode 12 is provided in the form of an annular conductor path electrically connected by way of a conductive layer 13 covering the wall of the bore 9 to a contact electrode 14 covering the underside of the carrier member 8.

An ignition bridge 15 extends radially between the inner end of the spiral shaped first electrode 10 and the annular second electrode 12, and it bridges the ring-shaped gap between these two electrodes. The ignition bridge 15 is in the form of a resistor and is preferably produced by a tantalum thin-film technique, or it is applied as a thick-film resistor and is arranged on the carrier member 8 between the electrodes 10 and 12.

The outer ring of electrode 10 is in flat contact with the bent-over end 3 of the ground contact ring 2, whereas the contact electrode 14 is in direct contact with the pole piece 7. The spiral-shaped first electrode 10 constitutes an inductance by means of which high-frequency signals are kept away from the ignition bridge 15. The inductance, however, does not affect the direct-current behavior of the ignition circuit. The inductance need not necessarily be made up of a spiral-shaped conductor path, but rather can also be, for example, in the form of a meander-like extension wherein different zones of the conductor path extend with substantially constant spacing along nonlinear routes.

In the embodiment illustrated in FIGS. 3*a* and 3*b*, the first electrode 10 has an annular or ring shape with radial projections 16 extending inwardly from the ring. The second electrode 12 has the form of a round disk with projections 17 that point radially outwardly with these projections 17 engaging in or being disposed in the gaps between the projections 16 of the first electrode 10. The two electrodes 10, 12 are separated from each other by a strip-shaped gap 11 of a constant width so that both conductor paths extend in close mutual spacing substantially in parallel to each other and the electrodes thereby form a capacitance. The ignition bridge 15 is arranged in a broader zone between the electrodes 10, 12. The capacitcance constituted by the electrodes is connected electrically in parallel with the ignition bridge 15 and, thus, acts as an anti-interference capacitor.

In the embodiment illustrated in FIGS. 4*a* and 4*b*, the second electrode 12 is in the form of a ring surrounding the bore 9, whereas the first electrode 10 or conductor path forms a parallel-resonant circuit made up of parallel-connected capacitances and inductances. The first electrode 10 comprises two mutually opposed marginal zones 18 and a central zone 19 surrounding the second electrode 12 at a spacing. The central zone 19 projects into each of the marginal zones 18, but is separated from the latter by respectively one meander-shaped perforation 11 of constant width. This creates areas 27, 28 in conductor paths 10 which are located short distances apart so as to constitute the capacitance. The inductances consist of loop-shaped areas 20 having the configuration of open circular loops or rings. The open circular rings are connected with one of their ends to the marginal zones 18 and with the other ends to the central zone 19. The circular perforation between the central zone 19 of the first electrode 10 and the second electrode 12 is bridged by the ignition bridge 15.

In the embodiment illustrated in FIGS. 5*a* and 5*b*, a primer cap, i.e., a wire detonator, is utilized. The carrier member herein is a board 21 of insulating material provided on both sides with laminated conductors. The front lamination constitutes the first electrode 10 and the rear lamination is the second electrode 12. Both electrodes 10, 12 are connected with each other by an ignition bridge 15 consisting of a bridging wire. The end of the insulating board 21 is arranged in the interior of a component 22 of insulating material which also contains the ends of the lead wires 23. These ends are connected to the respective electrode 10 and/or 12 by soldering points 24.

The first electrode 10 is provided with a meander-like perforation 11 with areas 29, 30 which are a short distance apart so that a capacitance is formed in this zone. In parallel to the capacitance, an inductance is arranged consisting of a section 25 in the shape of an open conductor loop extending along an otherwise conductor-free zone 26 of the insulating board 21. In this way, an LC filter is created, the electric equivalent circuit of which is made up of the parallel connection of an inductance and a capacitance, connected in series with the ignition bridge 15.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

What is claimed is:

1. An electric detonator device comprising an electrically insulating carrier member carrying an ignition bridge and first and second electrodes connected to the ignition bridge, at least one of the first and second electrodes being in the form of a layered conductor path configured to provide a high-frequency filter, whereby the connection of the ignition bridge to the at least one of the first and second electrodes formed as a layered conductor path configured to provide a high frequency filter is only by the layered conductor path thereof.

2. An electric detonator device according to claim 1, wherein the layered conductor path is configured to provide at least one of an inductance and capacitance.

3. An electric detonator device according to claim 2, wherein the layered conductor path is configured in at least one portion thereof as a capacitance, different zones of the layered conductor path extending with substantially constant spacing along nonlinear routes.

4. An electric detonator device according to claim 3, wherein the layered conductor path is configured entirely as a capacitance.

5. An electric detonator device according to claim 2, wherein the layered conductor path is configured in at least one portion thereof as a series inductance.

6. An electric detonator device according to claim 5, wherein the layered conductor path is configured as a spiral.

7. An electric detonator device according to claim 5, wherein the layered conductor path is configured entirely as a series inductance.

8. An electric detonator device according to claim 3, wherein the layered conductor path is configured in at least another portion thereof as an inductance.

9. An electric detonator device according to claim 1, wherein the layered conductor path is configured as a parallel resonant circuit.

10. An electric detonator device according to claim 2, wherein the layered conductor path is configured as a parallel resonant circuit.

11. An electric detonator device according to claim 8, wherein the layered conductor path is configured as a parallel resonant circuit.

12. An electric detonator device according to claim 1, wherein both the first and second electrodes are in the form of layered conductor paths configured together to form a parallel capacitance with respect to the ignition bridge, both conductor paths extending in close mutual spacing in parallel to each other.

13. An electric detonator device according to claim 12, wherein the carrier member is an insulating cylinder having a bore therethrough, the first electrode having a layered conductor surrounding the bore on one surface of the cylinder and a configuration of a disk with projections extending radially outwardly, the second electrode having a layered conductor on the one surface of the cylinder and having a configuration of an annular ring with radial projections extending radially outwardly toward the first electrode, the outward projection of the first electrode being disposed in gaps between the inward projections of the second electrode with the first and second electrodes being spaced from one another in a zone of the inward and outward radial projections by a constant spacing to provide a capacitance, the ignition bridge being connected between the first and second electrodes in a zone where the inward and outward radial projections are not provided.

14. An electric detonator device according to claim 5, wherein the carrier member is an insulating cylinder having a bore therethrough, the first electrode having a layered conductor path configured as an annular portion surrounding the bore on one surface of the cylinder, the second electrode having the layered conductor path configured as the spiral on the one surface of the cylinder and spaced from the first electrode, and the ignition bridge being connected between the first and second electrodes.

15. An electric detonator device according to claim 8, wherein the carrier member is an insulating cylinder having a bore therethrough, the first electrode having a layered conductor path configured as an annular portion surrounding the bore on one surface of the cylinder, the second electrode having the layered conductor path on the one surface of the cylinder with at least one portion providing the series inductance and at least another portion providing the capacitance, the first and second electrodes being spaced from one another, and the ignition bridge being connected between the first and second electrodes.

16. An electric detonator device according to claim 1, wherein the carrier member is an insulating board having the first electrode on one side surface and the second electrode on the opposite side surfaces, the ignition bridge being a wire connected between the first and second electrodes and extending from the one side surface to the opposite side surface, the second electrode providing the layered conductor path configured to provide the high-frequency filter.

17. An electric detonator device according to claim 16, wherein the layered condcutor path is configured to provide at least one of an inductance and capacitance.

18. An electric detonator device according to claim 17, wherein the layered conductor path is configured in at least one portion thereof as a capacitance, different zones of the layered conductor path extending with substantially constant spacing along nonlinear routes.

19. An electric detonator device according to claim 18, wherein the layered conductor path is configured in at least another portion thereof as an inductance.

20. An electric detonator device according to claim 1, wherein the layered conductor path is configured so as to provide a series inductance connected in parallel with a capacitance, the capacitance being provided in areas of the layered conductor path outside of the inductance configured so that areas of the layered conductor path are located a short distance apart.

21. An electric detonator device according to claim 20, wherein the series inductance is configured as an open loop portion of the layered conductor path.

22. An electric detonator device according to claim 5, wherein different zones of the layered conductor extends with substantially constant spacing along nonlinear routes.

* * * * *